US006427779B1

(12) United States Patent
Richman

(10) Patent No.: US 6,427,779 B1
(45) Date of Patent: Aug. 6, 2002

(54) MARINE PORTABLE CHEMICAL APPLICATOR

(76) Inventor: Ira S. Richman, 1450 Harbor Island Dr., No. 91, San Diego, CA (US) 92101

( * ) Notice: Subject to any disclaimer, the term of this patent is extended or adjusted under 35 U.S.C. 154(b) by 0 days.

(21) Appl. No.: 09/784,995

(22) Filed: Feb. 14, 2001

(51) Int. Cl.[7] ..... A62C 11/00; A62C 15/00; B05B 9/08

(52) U.S. Cl. ..... 169/30; 239/152; 239/153

(58) Field of Search ..... 169/30, 14, 15, 169/51, 52, 85; 2/81, 82, 84, 85, 88; 239/318, 310, 337, 152, 153

(56) References Cited

U.S. PATENT DOCUMENTS 2,044,687 A 6/1936 Hatten
3,904,087 A * 9/1975 McRoskey et al. ..... 222/193
4,688,643 A 8/1987 Carter et al.
5,137,094 A 8/1992 Broussard
5,150,476 A * 9/1992 Statham et al. ..... 2/93
5,445,226 A 8/1995 Scott et al.
6,209,144 B1 * 4/2001 Carter ..... 2/458

* cited by examiner

*Primary Examiner*—Lesley D. Morris
*Assistant Examiner*—Davis Hwu
(74) *Attorney, Agent, or Firm*—Joseph F. McLellan

(57) ABSTRACT

A chemical foam applicator for fighting shipboard fires, and including a foam mixing nozzle assembly connectable to a pressurized source of water to develop a vacuum for drawing foam concentrate from a jacket worn by the fire fighter. The jacket comprises a one-piece sheet of material folded over to define a fire resistant exterior enclosing a one-piece, continuous bladder for holding foam concentrate. The unitary nature of the bladder enables it to be easily fabricated and drained using a hose located interiorly of the bladder.

1 Claim, 4 Drawing Sheets

FIG. 1
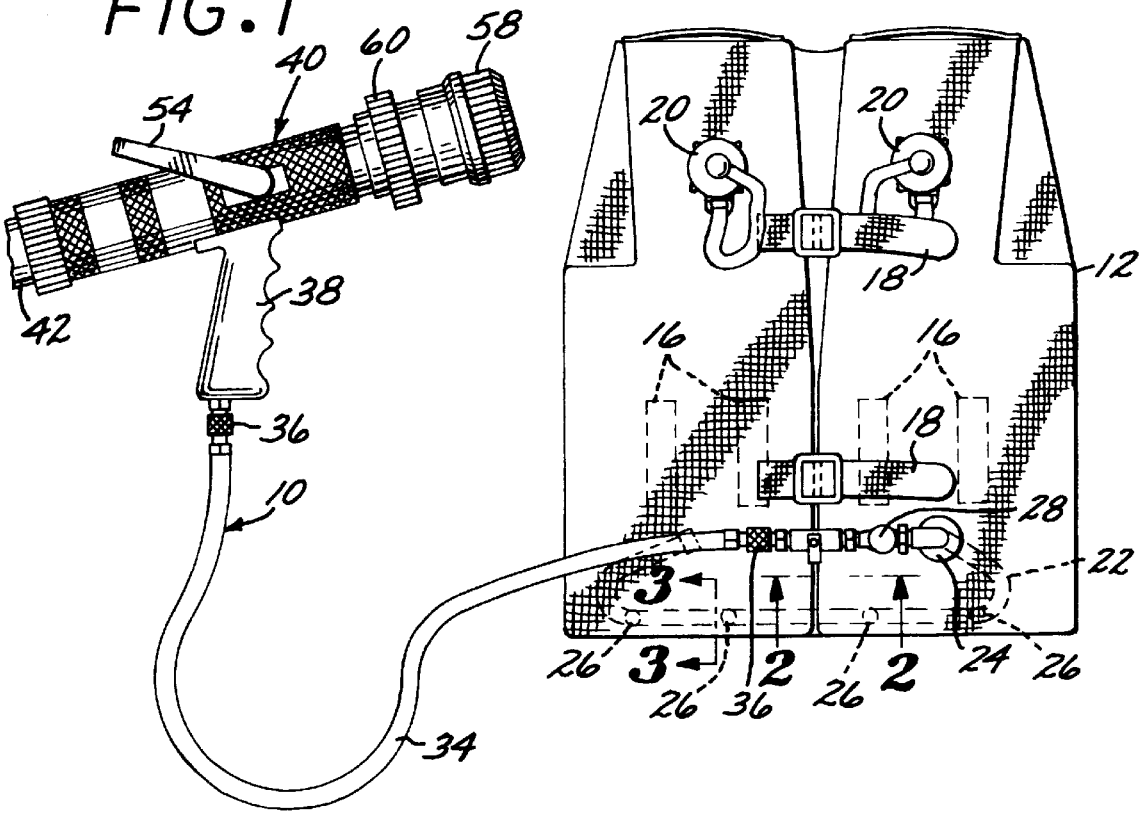
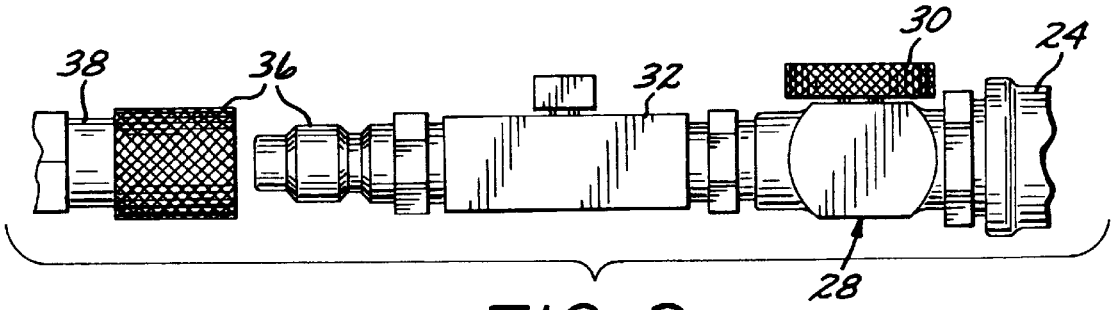
FIG. 2
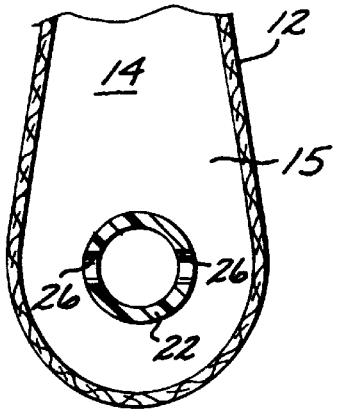
FIG. 3

MARINE PORTABLE CHEMICAL APPLICATOR

BACKGROUND OF THE INVENTION

1. Field of the Invention

The present invention relates to rapid response fire fighting equipment, and more particularly to a portable water and chemical foam applicator for marine or shipboard use.

2. Description of the Prior Art

Most fire fighting equipment found aboard ship uses foam produced by mixing water with a chemical foam concentrate. Sometimes water alone is sufficient for a particular fire, but the foam produced by mixing water with the foam concentrate is usually much more effective because it not only knocks down a fire but follows up by smothering it. However, this happy result occurs only if there is an immediate and ample supply of foam at the fire scene. Failing this, it will be only a matter of minutes if not seconds before the fire generates temperatures so high that the resultant rapidly moving flame front quickly places the fire out of control.

Water and foam systems used by most large commercial and U.S. Navy ships generally fall into one or more of the following categories:

1) so-called in-line foam generating and mixing equipment that is fixed or permanently installed in position. This type of equipment can produce relatively large quantities of foam, but because it is fixed in position it can deliver the foam to remotely located sites only through long foam supply hoses. Hoses take a significant amount of time to unreel and deploy, and they clutter the fire scene;
2) self-contained and portable equipment mounted on a cart or other vehicle for movement to the fire scene. This type of equipment can only transport a limited quantity of foam concentrate. It also has the disadvantage that it takes time to reach the scene, unreel and deploy the foam applicator hoses, connect fire hoses to the equipment, operate the foam mixture apparatus, and pump the mixture to the fire scene through the foam applicator hoses;
3) a third system is extremely portable and can be deployed to locations not easily reached by carts or the like, nor by long hoses connected to in-line equipment, carts or other wheeled equipment. The foam concentrate is placed in a reservoir of some kind that is mounted or strapped onto a person, and the person can then simply walk to the scene of the fire. Although the storage capacity of these body mounted foam applicators is much less than that of the systems referred to earlier, they can be immediately deployed. They are also flexible in the sense that a person wearing the foam applicator can move wherever the rapidly changing character of a fire requires. U.S. Pat. Nos. 5,445,226 (Scott et al), 2,044,687 (Hatten), and 4,688,643 (Carter et al) disclose such equipment worn as a back pack.

This type of body mounted equipment can be used by a team of firefighters, each carrying a separate supply of the foam concentrate. One team member, the nozzle man, can fight a fire until his supply of concentrate is almost exhausted. At that time the supply hose extending from the jacket to the nozzle is detached, and another team member, the hose man, wearing a similar jacket can attach his supply hose to the nozzle to continue the task of the prior nozzle man, relieving him to go back and replenish his supply. This teamwork procedure enables a more or less continuing application of foam to the fire.

Like all of the above discussed systems, the body mounted foam concentrate must be mixed with water at the fire scene. This is done by using water made available at the fire scene by usual fire hoses connected to a suitable water source.

Mixture of the water and concentrate takes place in a nozzle which forms a part of the body mounted equipment. Water passes through the nozzle at a relatively high rate of flow, developing a reduced pressure in the foam concentrate supply line. This draws foam concentrate into the nozzle where it is mixed with the water and aerated.

The nozzle can be operated to use water or any other fluid, if desired.

Some versions of the third type of body mounted equipment are worn on the back in the form of a depending bag or back pack. These are difficult to maintain in position because the weight and volume of the contained foam concentrate tends to shift, particularly in moving through confined spaces, and this makes it fatiguing for an individual to carry all of the weight on his or her back.

Other body mounted applicators are shoulder mounted to alleviate this problem. Several take the form of a two-piece vest or jacket which is worn over the shoulders and extends down across the front and back of the wearer.

The manufacture and assembly of such a multi-part jacket is relatively expensive, tedious and labor intensive because it involves two separate front and back sections or portions that have to be connected by front and back straps or the like. Also, there is additional expense and complexity arising from the fact that the two separate reservoirs or bladders of the separate portions have to be specially bonded, sewn or formed in place to be waterproof, and the separate portions interconnected to enable emptying of the bladders through a common drain port.

In one embodiment of the prior art such interconnection is provided by a flexible external hose that extends between the two portions. This enables the concentrate to flow into the portion having the drain port, but the external location of the hoses exposes them to significant wear and tear, and possible entanglement with associated equipment or structures encountered in fighting the fire.

Each of the portions of a two piece jacket are relatively heavy when filled with concentrate, and they tend to shift in position when restrained primarily by separate neck or shoulder straps. This type of arrangement is disclosed in U.S. Pat. No. 5,137,094 (Broussard). Unwanted shifting of the weight and center of gravity is an important consideration since fighting fires is extremely tiring and any unbalanced or poorly distributed foam concentrate makes the job of carrying the concentrate that much more fatiguing. The extra exertion required could mean that the fire fighter becomes prematurely fatigued to the point that he or she is taken off the fire, or worse, becomes incapable of escape from rapidly developing hot spots or fire storms.

In summary, portable foam applicators of the prior art typically lack one or more features that are important for optimum performance, such as a high capacity, unitary foam concentrate internal storage bladder or the like, a unitary or one-piece jacket or vest, a self-educting foam nozzle, a foam concentrate ratio controller, and easily controllable dispersion means for applying the foam to a fire. The equipment must also be lightweight, easily donned, capable of being rapidly filled and evenly emptied, possess optimum or proper weight balance, and be made of state-of-the-art fireproof material.

SUMMARY OF THE INVENTION

According to the present invention, a portable foam applicator is provided in the form of a one-piece or unitary vest or jacket having front and back portions adhered or bonded together at their edge margins to form heat reflective exterior surfaces and leakproof interior surfaces which define an internal chamber or bladder to hold foam concentrate.

In addition to the edge margin bonds, a pair of elongated, laterally spaced apart, and vertically extending bonds are provided inwardly of the edge margins. These secure the front and back portions together at the bonds, constitute barriers to any sudden lateral displacement or sloshing of the contained foam concentrate which might cause sudden changes in the distribution of the weight of the foam concentrate in the jacket. .

An interior foam concentrate pickup hose is installed within the jacket bottom for extension along its bonded inside perimeter. The hose includes a number of openings along its length to permit foam concentrate to flow from the jacket interior or bladder into the hose.

The discharge extremity of the inner pickup hose is attached or bonded to a jacket fitting, and an exterior pickup hose is connected to the fitting to accept concentrate from the interior pickup and carry it to the exterior of the jacket and through a ratio controller mounted to the exterior pickup hose. The ratio controller is operative to establish the desired percentage of concentrate to feed water. Fire conditions change and a control element on the ratio controller can be quickly adjusted to select the optimum one of various concentrate percentages.

The jacket of the present invention includes a nozzle which is supplied with feed water by a fire hose or the like. The feed water flows rapidly through the nozzle body and develops a negative pressure at the exterior pickup hose sufficient to draw concentrate from the jacket interior, through the ratio controller, through a feed or shut-off valve downstream of the ratio controller, and into the nozzle so that the concentrate and water are mixed and aerated to provide the desired foam.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 1 is front perspective view of the jacket of the present invention as seen in combination with a self-educting nozzle assembly;

FIG. 2 is an enlarged view taken along the line 2—2 of FIG. 1;

FIG. 3 is an enlarged view taken along the line 3—3 of FIG. 1;

DESCRIPTION OF THE PREFERRED EMBODIMENT

Figures 4, 5:
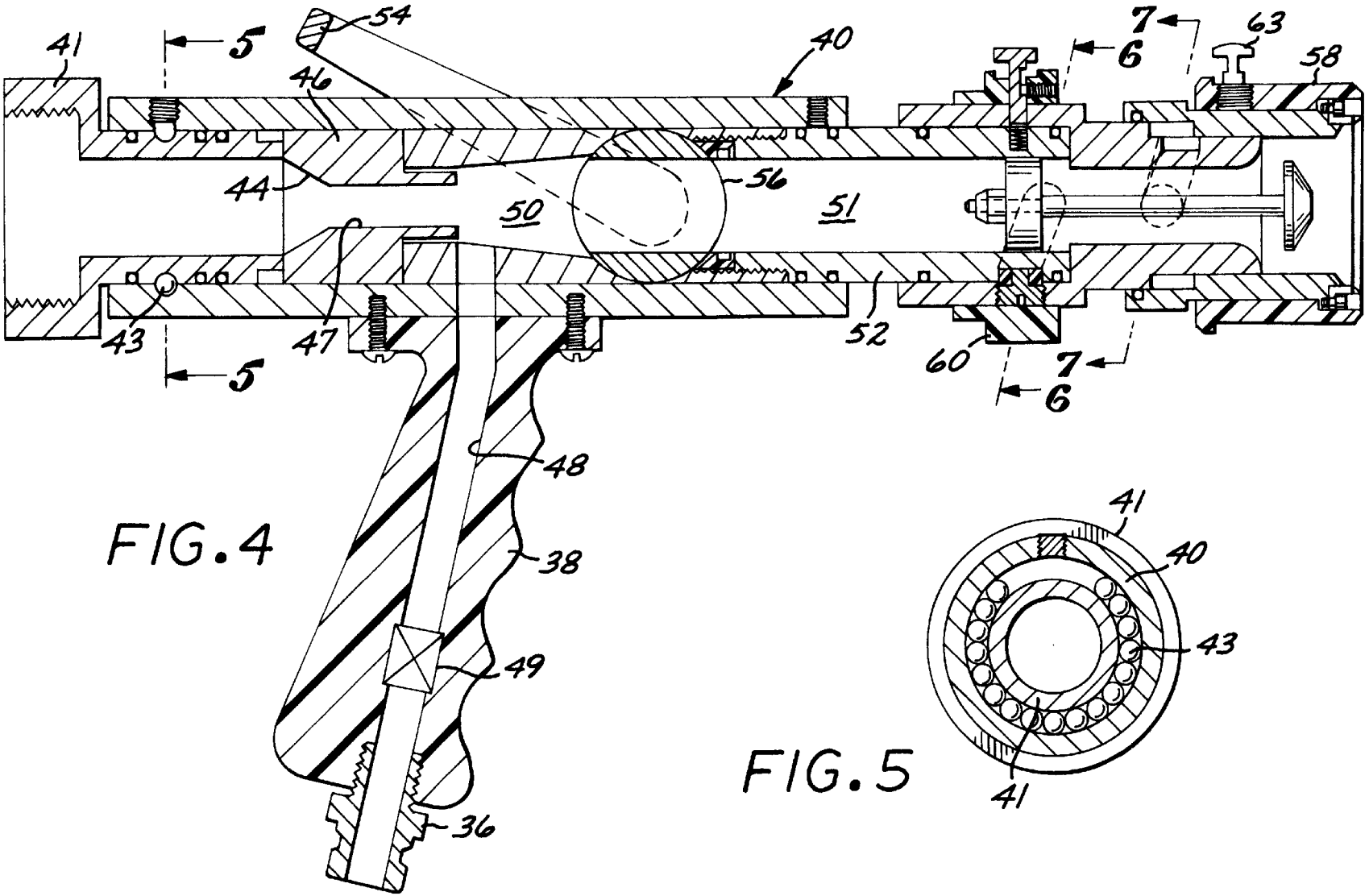
FIG. 4 is a longitudinal cross sectional view of the nozzle assembly.
FIG. 5 is a view taken along the line 5—5 of FIG. 4.
Figure 6:
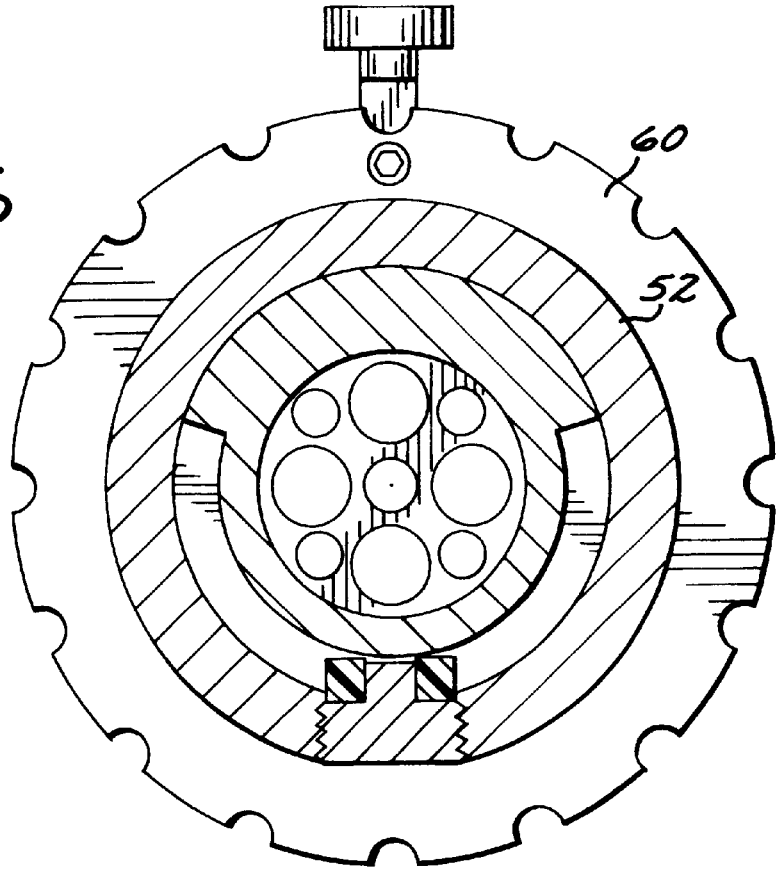
FIG. 6 is an enlarged view taken along the line 6—6 of FIG. 4.
Figure 7:
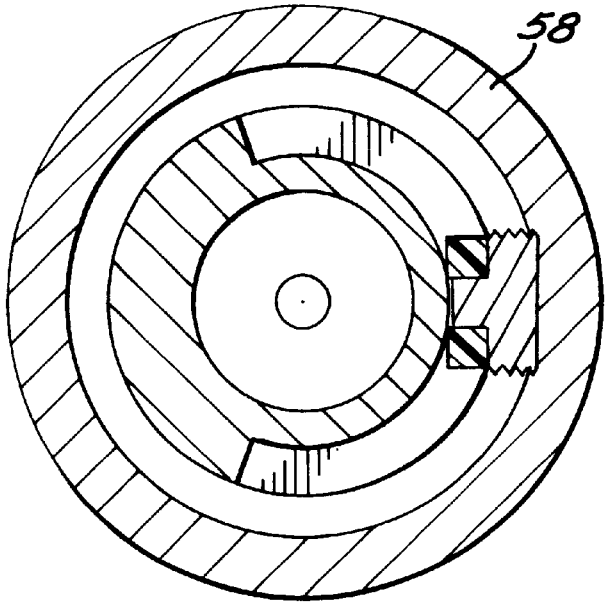
FIG. 7 is an enlarged view taken along the line 6—6 of FIG. 4.

Referring now to the drawings, the present portable chemical applicator is illustrated in the form of a foam applicator 10 for shipboard or marine use. It comprises a generally rectangular one-piece or unitary reservoir or bladder 12 which is preferably made of leak-proof polyester vinyl material. The material of the bladder 12 is suited for containing water or chemicals such as the liquid concentrate commonly used in controlling or extinguishing Class A and Class B hydrocarbon fires on ships, or in dispersing hydrocarbon spills on or around a ship.

The bladder 12 is clad or covered with a suitable flame retardant cloth such as a fabric known in the trade as "Nomex". Both the bladder and fabric are configured so that when folded in the middle they form a sleeveless vest or jacket 14 with detachable sleeves or large arm holes. The fire resistant fabric constitutes the outer surface of the jacket, while the bladder constitutes the inner surface of the jacket, forming a single, continuous interior chamber 15.

The chamber 15 is rendered leak-proof and the folded over sections of the jacket are secured together or bonded at their perimeters to form the jacket. Bonding can be done using any suitable adhesive, but it is preferred to use dielectric or electronic heat sealing methods well known in the prior art.

In addition, the interiors of the jacket sections are bonded to define a pair of relatively narrow, vertically extending areas 16, as indicated in dotted outline in FIG. 1. These are spaced apart from each other and also from the adjacent side margins of the jacket, as illustrated. They keep the jacket from ballooning out when it is filled with concentrate. They also tend to reduce rapid lateral flow or sloshing of the concentrate when the jacket is tipped, as might occur when the wearer is moving through confined or narrow spaces. This in turn promotes maintenance of the weight distribution built in to the jacket by the original configuration and location of the jacket bladders and helps the wearer to maintain his balance in such situations.

The jacket is continuous across the back, but the front can be opened to don the jacket. A pair of suitable "Velcro" type straps 18 are vertically spaced apart and span the front opening so that the jacket can be adjusted to fit the wearer and then tightened to maintain the jacket in position.

A pair of fill ports 20 are provided in the upper left and upper right portions of the front section of the jacket. These are suitably reinforced and securely bonded in position. The ports 20 communicate with opposite extremities of the interior reservoir or bladder of the jacket so that chemical concentrate poured into one or both of the ports 20 will flow to the bottom of the bladder and rise in the jacket as the bladder is filled. The ports are of relatively large diameter, in the order of 2.50 to 3 inches, to enable rapid filling of the jacket. Also, when filling one port the other can act as a vent, and when both ports are being used, the clearance between the filling hose (not shown) and the periphery of the ports provides sufficient venting passages.

A flexible interior pick up hose 22 is arranged on the bottom of the jacket, extending adjacent the bottom edge margins of the bonded front and back sections of the jacket. The hose is open at one end and connected at its opposite end to a discharge port 24 sewn or bonded in the front of the jacket. The hose 22 is provided with inlet openings 26 along its length so that foam concentrate in the jacket bladder can flow into the openings when the bladder is being emptied.

Although not illustrated, the jacket is also provided with reflective low light sensitive strips of cloth to make others aware of the presence of the firefighter in dark areas. The strips are preferably sewn over the shoulders, down the front and back of the jacket, and also around the waist, as will be apparent to those skilled in the art.

The discharge port 24 includes an elbow section which is connected to a ratio controller 28. An adjustment knob 30 on the controller can be rotated to adjust the proportion of the concentrate relative to water at 1%, 3%, 6% etc., as necessary to best combat a fire. The knob 30 also has a shut-off position which terminates concentrate flow to the jacket so that a fire can be fought with water alone if desired.

A ball valve 32 is connected to the discharge end of the controller. With a quarter turn it will shut off any flow of concentrate out of the jacket, which is useful when the jacket is in storage.

An exterior pick up hose 34 is attached at its opposite extremities by suitable quick disconnect fittings 36 to the discharge end of the ball valve 32, and to the inlet end of a pistol grip 38, respectively. The fluid passage through the pistol grip includes a one-way check valve 49 to prevent reverse flow back into the jacket.

The grip 38 is attached to the nozzle body 40 and provides a convenient means for holding and operating it, and particularly in attaching it to a conventional fire hose 42 by means of a swivel 41, which is rotatably mounted to the inlet end of the nozzle body. Conventional ball bearings 43 are disposed between the swivel 41 and the nozzle body to enable easy relative rotation.

An eductor fitting 46 is located adjacent the swivel 41 and includes a throat section or venturi nozzle 44. The nozzle is reduced in diameter in a downstream direction to define a lesser diameter eductor passage 47 that extends into a vacuum chamber 50 of the nozzle body. Water rapidly flowing through the venturi nozzle 44 and the passage 47 develops a vacuum in the chamber 50, drawing foam concentrate through the passage 48 in the pistol grip 38.

As such flow continues into the mixing chamber 51, the water and foam are mixed and aerated. The nozzle is operative to proportion foam concentrate solution between 35 psi and 180 psi.

The rotated position of a ball valve 56 is controlled by a bale 54 to regulate the amount of water flowing through the nozzle. The spray pattern for expansion of the mixture is adjustable by rotation of a bumper 58 mounted at the end of the nozzle body. The pattern can be either a straight stream, power cone, or full fog, as desired.

In addition to mixing occurring in the chamber 51, the spray components are further mixed at the face of the bumper 58.

A flush ring 60 is actuable to drive foreign particles out of the spray and restart the flow of foam in the event of a blockage of the flow within the nozzle body.

Figure 8:
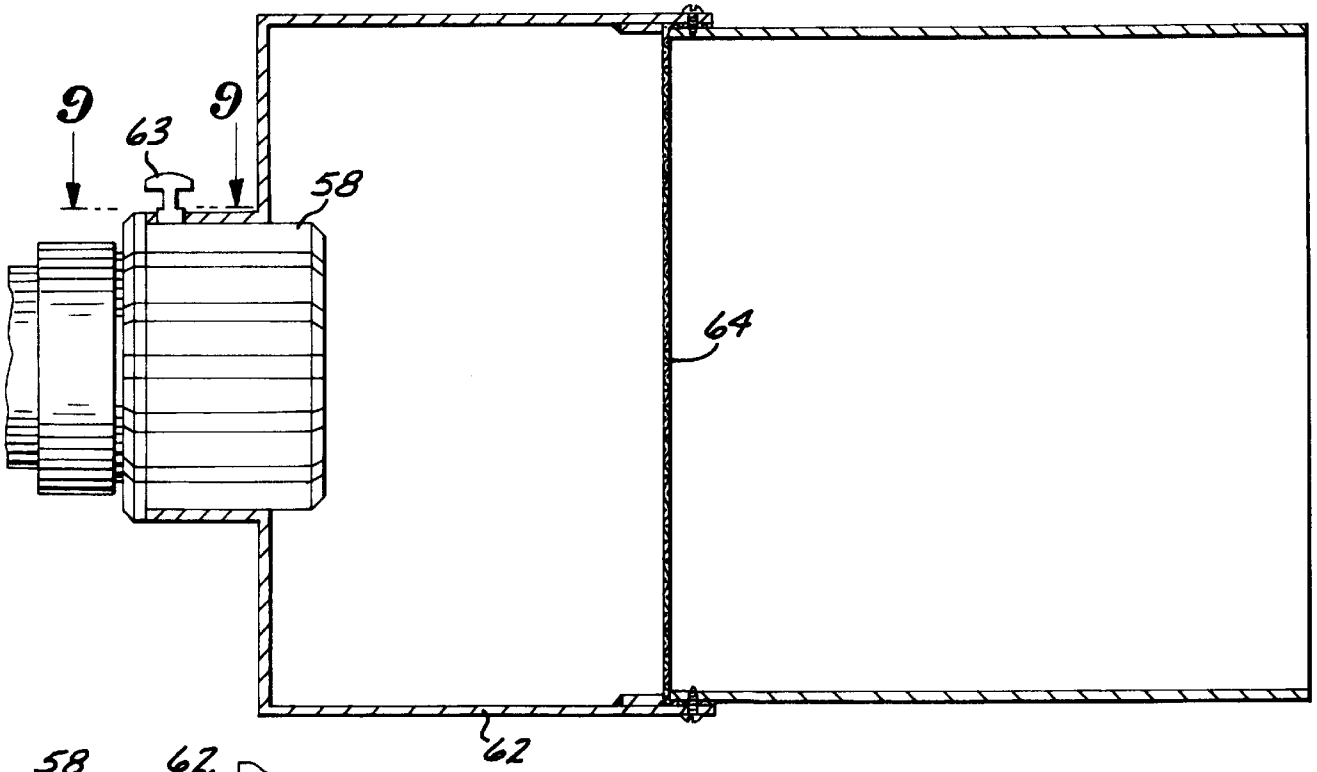
FIG. 8 is a longitudinal cross sectional view of the expansion tip and screen attached to the end of the nozzle assembly.
Figure 9:
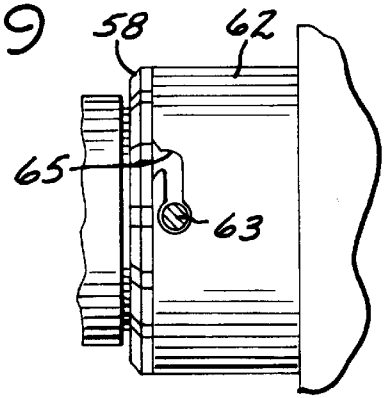
FIG. 9 is a view taken along the line 9—9 of FIG. 8.

A low/medium expansion tube 62 is detachably mounted to the end of the bumper 58 by a quick release, spring actuated button 63, as seen in FIGS. 8 and 9. The button 63 is movable through a bayoneted slot 65 for rapid attachment and detachment of the tube 62, as desired.

The bumper structure is operative to expand the foam mixture from a ratio of 10:1 up to 30:1, such as by turning a variable solution pattern controller located within the bumper 58. Additional expansion is also produced by a mesh screen 60 located in the middle of the expansion tube.

From the foregoing it will be seen that the present invention constitutes an improved foam applicator especially adapted for combating shipboard and marine related fires.

It comprises a unitary or one-piece jacket into which foam concentrate can be quickly and conveniently loaded through a pair of oversize fill ports. The unitary jacket is formed to define a unitary bladder extending around the back and sides, and all of the front except for the usual frontal opening found in jackets to enable a wearer to don it without having to pull it over his head.

The one-piece jacket is very easily and inexpensive to construct because there are so few parts that need to be joined together, and this joining is done by electronic bonding to achieve the most leakproof structure possible.

The outer material and internal reservoir or bladder of the jacket comprise layers of a single folded over section of material. As just indicated, this makes possible a bladder which is internally continuous except at the small area between the edge margins of the front of the jacket.

The internally continuous nature of the bladder enables all portions of the bladder to be filled with foam concentrate at the same time through large fill ports. It also enables employing of all portions of the bladder through a single discharge port in the jacket.

An internal hose facilitates collection of the foam concentrate from all portions of the jacket for discharge from the single discharge port. Thus, external connecting hoses can be completely eliminated so that nothing can snag or become entangled with objects or structures near the jacket.

Various modifications and changes may be made with regard to the foregoing detailed description without departing from the spirit of the invention.

What is claimed is:

1. A portable chemical foam applicator for shipboard use comprising:

foam generation apparatus including a self-educting nozzle for mixing water and foam concentrate to produce foam for application to a fire;

a unitary vest having a frontal opening enabling a fire fighter to don the vest from the front, the vest being continuous across the back, sides and those portions of the front located laterally outwardly of the margins defining the frontal opening, the vest including a unitary internal bladder for holding foam concentrate, an internal discharge hose extending around the interior of the bladder and connected to a discharge port in fluid communication with the nozzle, the hose having a plurality of openings along its length whereby foam concentrate may be drawn by the by self-educting nozzle from the bladder and through the hose openings for subsequent mixing with water in the nozzle to produce the foam, the vest being fabricated of a single sheet of material folded along its middle to define an outer surface of fire resistant material and an inner surface defining the bladder, the folded sheet being fabricated to form arm holes in the folded sheet, the margins of the folded sheet being bonded to render the bladder leakproof, the vest further including relatively narrow, vertically extending and laterally spaced apart bonded areas joining the interior of the front and back of the vest, the bonded areas preventing ballooning of the filled vest, and also reducing rapid lateral displacement or sloshing of the chemical concentrate in the vest which might otherwise result in an unexpected change in the center of gravity of the contained concentrate.

* * * * *